US008376717B2

(12) United States Patent
Huttar

(10) Patent No.: US 8,376,717 B2
(45) Date of Patent: Feb. 19, 2013

(54) MULTI-STAGE COMPRESSOR

(75) Inventor: Ernst Huttar, Klosterneuburg (AT)

(73) Assignee: Leobersdorfer Maschinenfabrik AG, Vienna (AT)

( * ) Notice: Subject to any disclaimer, the term of this patent is extended or adjusted under 35 U.S.C. 154(b) by 388 days.

(21) Appl. No.: 12/374,685

(22) PCT Filed: Aug. 16, 2007

(86) PCT No.: PCT/AT2007/000392

§ 371 (c)(1),
(2), (4) Date: Oct. 19, 2009

(87) PCT Pub. No.: WO2008/019416

PCT Pub. Date: Feb. 21, 2008

(65) Prior Publication Data

US 2011/0164990 A1 Jul. 7, 2011

(30) Foreign Application Priority Data

Aug. 16, 2006 (AT) ..... GM 620/2006

(51) Int. Cl.
*F04B 23/12* (2006.01)
*F04B 3/00* (2006.01)
*F04B 5/00* (2006.01)

(52) U.S. Cl. ..... 417/206; 417/244; 417/313

(58) Field of Classification Search ..... 417/206, 417/254, 404, 534, 535, 536, 244, 247, 313
See application file for complete search history.

(56) References Cited

U.S. PATENT DOCUMENTS

| | | | | | |
|---|---|---|---|---|---|
| 341,099 | A * | 5/1886 | Dow | 417/243 |
| 1,388,780 | A * | 8/1921 | Stanley | 417/536 |
| 1,855,673 | A * | 4/1932 | Hansen | 417/253 |
| 2,702,008 | A * | 2/1955 | Stockard | 417/265 |
| 3,744,936 | A * | 7/1973 | Sadler | 417/536 |
| 4,615,259 | A * | 10/1986 | Anbe | 92/86 |
| 4,662,826 | A * | 5/1987 | Nitta et al. | 417/206 |
| 4,756,674 | A * | 7/1988 | Miller | 417/534 |
| 4,789,310 | A * | 12/1988 | Hung | 417/234 |
| 2004/0197197 | A1 * | 10/2004 | Huttar et al. | 417/206 |

FOREIGN PATENT DOCUMENTS

| | | |
|---|---|---|
| DE | 29 39 298 | 9/1980 |
| DE | 199 47 444 | 4/2001 |
| FR | 944 598 | 4/1949 |
| FR | 1 231 185 | 9/1960 |
| FR | 2 369 962 | 6/1978 |
| GB | 458333 | 12/1936 |
| GB | 597437 | 1/1948 |
| WO | 02/44564 | 6/2002 |
| WO | 03/010436 | 2/2003 |

* cited by examiner

*Primary Examiner* — Peter J Bertheaud
(74) *Attorney, Agent, or Firm* — Ladas & Parry LLP

(57) ABSTRACT

A multi-stage compressor (1) for compressing gases with a low-pressure region (2) and a high-pressure region (5), wherein at least one rotary compressor (3) is provided in the low-pressure region (2), and at least one reciprocating piston compressor (6) with two cylinders (7) is provided in the high-pressure region (5), and wherein a common engine (4) is provided for driving the rotary compressor (3) and the reciprocating piston compressor (6), wherein the cylinders (7) are arranged to be rotated relative to each other by 180° in the high-pressure region (5).

6 Claims, 4 Drawing Sheets

MULTI-STAGE COMPRESSOR

FIELD OF THE INVENTION

The invention relates to a multi-stage compressor for compressing gases with a low-pressure region and a high-pressure region, wherein at least one rotary compressor is provided in the low-pressure region, and at least one reciprocating piston compressor with two cylinders is provided in the high-pressure region, and wherein a common engine is provided for driving the rotary compressor and the reciprocating piston compressor.

BACK OF THE INVENTION

It has basically been known from WO 03/010436 A1 to combine a rotary compressor, in particular a screw-type compressor, in the low-pressure region with a reciprocating piston compressor in the high-pressure region. Here, a multi-stage reciprocating piston compressor is shown for high-pressure compressing of the gas to be compressed, wherein the cylinder of the individual compressor stages are arranged to be V-shaped towards each other. Here, the reciprocating piston compressor and the low-pressure compressor are driven via a common crankshaft.

Furthermore, it has been known from DE 4 313 573 to provide a screw-type compressor for low-pressure compression and a high-pressure piston compressor for high-pressure compression which is driven separately of the screw-type compressor.

Moreover, a method for improving cost-effectiveness of displacement compressors has additionally been known from DE 199 32 433 A1, wherein it has been disclosed to drive a centrifugal compressor either by means of the driving engine of a reciprocating piston compressor or by a separate engine.

Furthermore, a different vacuum pump has been known from U.S. Pat. No. 4,662,826, wherein gas is first sucked off by means of a rotary vacuum pump and subsequently via a reciprocating pump coupled to the crankshaft of the rotary vacuum pump. Yet, here, no internal compression of the gas to be sucked off takes place so that compared to a multi-stage high-pressure compression a possible heating of the gas to be compressed and/or a condensate accumulation is not to be considered.

Moreover, it has been basically known with piston compressors of different types to arrange the piston in boxer construction. A multi-stage piston compressor has been known from WO 2002/044564 A1 for generating compressed air for rail vehicles, said piston compressor consisting substantially of a drive unit and a down-stream compression unit and having a low-pressure and at least one high-pressure stage. Each of the cranks provided on a crankshaft has at least two opposing pistons attached thereto, wherein adjacent cranks are arranged to be offset relative to each other substantially by 180°; here, the pistons may be arranged to be vertically upright, horizontal or V-shaped.

In DE 29 39 298 A1 a reciprocating-piston-compressor plant is shown in general which comprises a boxer compressor, wherein the cylinder sleeves of a stepped cylinder are rotated by 180° and arranged oppositely.

Moreover, a combined unit consisting of combustion engine and pump or compressor has been known from GB 458 333 A. The pump or compressor unit has a crankshaft with three cranks, wherein two adjacent cranks are arranged to be offset relative to each other by 180° whose respective cylinders are located to oppose each other on a horizontal plane.

SUMMARY OF THE INVENTION

The object of the present invention resides in creating a multi-stage compressor of the initially defined type which has an improved oscillation behavior seen in contrast to comparable multi-stage compressors.

According to the invention, this is achieved in that the cylinders in the high-pressure region are arranged to be rotated relative to each other by 180°. The 180°-rotated opposite arrangement of the cylinders results in a substantially less-oscillating run of the pistons received in the cylinders for compressing the gas to be compressed. Thus, in combination with the rotary compressor provided in the low-pressure region, there results a highly compact multi-stage compressor which allows for a relatively high compression of a gas to be compressed to be achieved, with the oscillations generated by the multi-stage compressor being at the same time kept low. This is why the inventive multi-stage compressor is particularly suited for use in both mobile compressor plants and compressor plants mounted on a ship. Here, it is also particularly advantageous that the reciprocating piston compressor, whose at least two cylinders are rotated relative to each other by 180°, i.e. arranged in a so-called boxer construction, has a center of mass which is low compared to conventional cylinders, e.g. cylinders arranged in V-shaped manner towards each other.

In order to keep the total center of mass of the multi-stage compressor as low as possible, what is of great importance with mobile compressor plants, it is furthermore advantageous if the engine is arranged laterally next to the reciprocating piston compressor. Moreover, it is beneficial for a flat configuration with a consequently low center of mass if the longitudinal axis of a crankshaft of the engine is arranged to be substantially horizontal as is the longitudinal axis of the cylinder.

As regards a particularly compact design of the multi-staged compressor, it is beneficial to provide the common engine with two shaft ends so that the rotary compressor and the reciprocating piston compressor can simply be coupled to the engine at opposing output sides.

Alternatively, it is also conceivable for a particularly compact design to couple the rotary compressor to the engine-driven reciprocating piston compressor. In this case, only one single crankshaft is necessary via which both the rotary compressor and the reciprocating piston compressor are driven.

Since the inventive multi-stage compressor should be also particularly suited for mobile use on ships and trucks, it is beneficial if the multi-stage compressor has a comparably small span/width, without reducing its performance. This is advantageously achieved in that one stepped piston each is received in the cylinders. Alternatively, to achieve a small span it is likewise possible to design the cylinders to be double-acting. The comparably small span enables the multi-stage compressor to be advantageously received in ISO containers having a width of 8 feet (2.54 m) and a length of either 20 feet (6.079 m) or 40 feet (12.9 m). Multi-stage compressors known so far having both a rotary compressor and a reciprocating piston compressor, yet having the piston compressors arranged in a V-shaped manner towards each other cannot be received in ISO containers, considerably complicating mobile use.

In order to restrict the final compressor temperature in the high-pressure region to an admissible value, it is beneficial if the reciprocating piston compressor has several compressor stages. In case of too high a compression degree in a single compressor stage, a further compressor in a single compressor stage would be inefficient because of an increased temperature of the gas to be compressed.

In order to achieve an efficient control of the multi-stage compressor, it is beneficial to provide a control means between the individual compressor stages, wherein discharge valves, by-pass valves, adjustable clearances, speed governors and other instruments may be provided as control means. In particular, different mechanical, pneumatic, hydraulic, electric or electronic components may be used for controlling the multi-stage compressor, thus allowing for both an on-site control and a remote control.

As regards an efficient compression in the individual compressor stages, it is beneficial to provide at least one attenuator, one cooling device, one condensate separator, one drying device or one gas separator between the individual compressor stages. Here, the "individual" compressor stages can be assigned both to the low-pressure region and the high-pressure region or they may both be assigned to the high-pressure region.

BRIEF DESCRIPTION OF THE DRAWINGS

In the following, the invention will be explained in even more detail by way of the exemplary embodiments illustrated in the drawings, yet without being restricted thereto. Therein, in detail.

DETAILED DESCRIPTION

Figure 1:
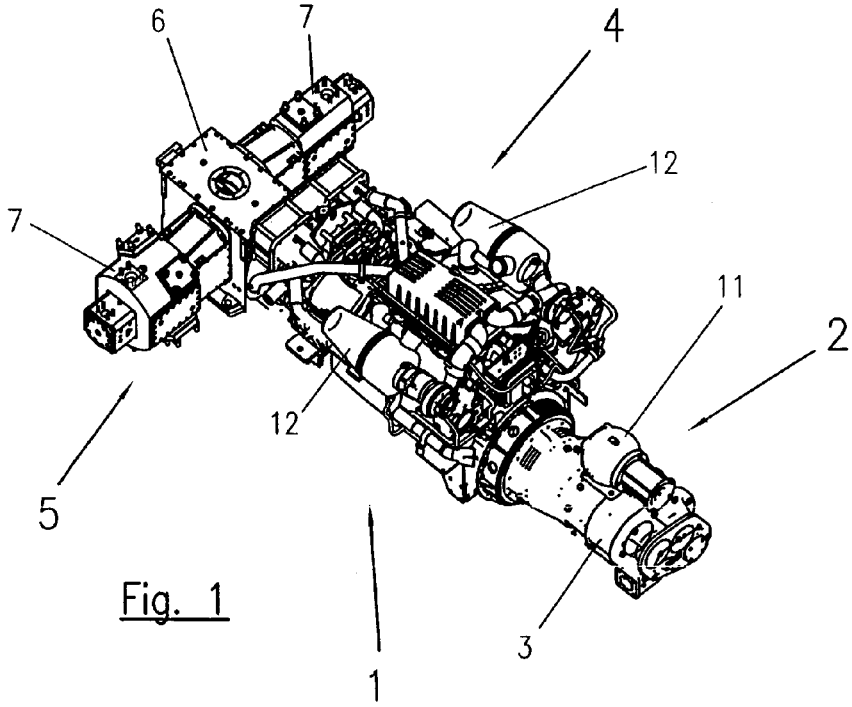
FIG. 1 shows a schematic perspective view of a multi-stage compressor, wherein a rotary compressor and a reciprocating piston compressor are arranged in boxer construction at opposing output sides of a central drive engine.

In FIG. 1, a multi-stage compressor 1 is shown, wherein a screw-type compressor 3 is provided in a low-pressure region 2. The screw-type compressor 3 is coupled to a central drive engine which drives the reciprocating piston compressor 6, likewise arranged in the high-pressure region 5, via a further crankshaft. Here, the reciprocating piston compressor 6 has two cylinders 7 arranged to be rotated relative to each other by 180° so that the reciprocating piston compressor 6 is designed in a so-called "boxer construction", wherein the pistons 7' received in the cylinders 7 (cf. FIG. 3) run on the same plane of motion. Here, the neutralization of forces of inertia of first order results in a high running smoothness of the reciprocating piston compressor 6 so that the multi-stage compressor 1 has an improved oscillation behavior compared to devices known. Moreover, a flat and short construction is achieved thereby so that the center of mass is low compared to known devices, what is particularly advantageous when using the multi-stage compressor 1 on ships.

Figure 2:
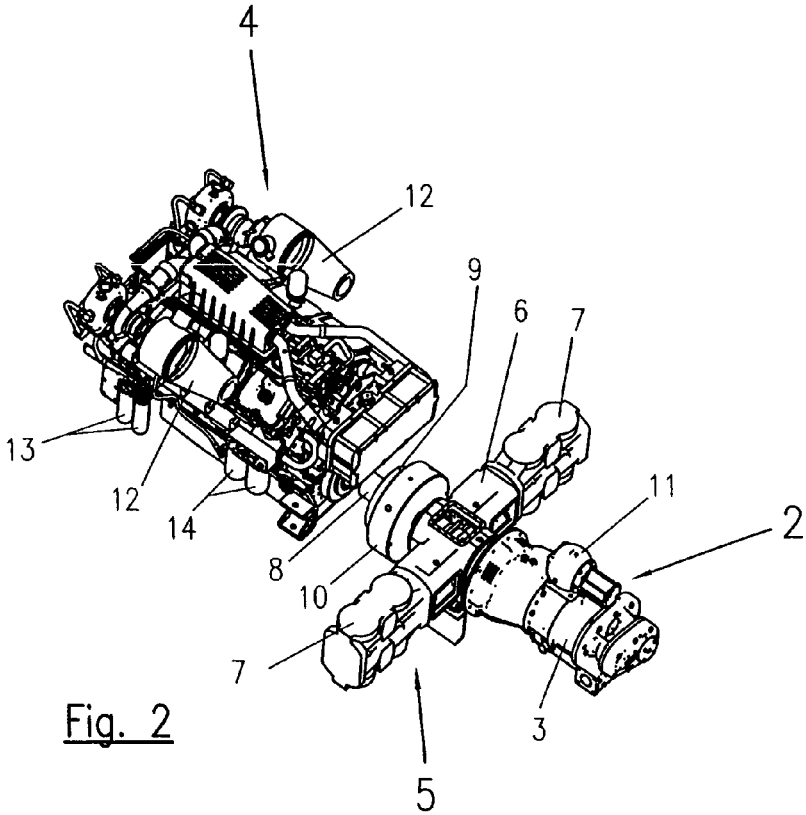
FIG. 2 shows a schematic perspective view of another exemplary embodiment, wherein the rotary compressor is coupled to the crankshaft of the reciprocating piston compressor of boxer construction.

In FIG. 2, an alternative exemplary embodiment is shown, wherein, here, the drive engine 4 has only one crankshaft 8 which drives the reciprocating piston compressor 6 of boxer construction via a coupling 10, with a gyrating mass 9 being interposed. Then, the screw-type compressor 3 provided in the low-pressure region 2 can be driven via the same crankshaft.

In particular, it is furthermore visible from FIGS. 1 and 2 that an inlet control valve 11 is assigned to the screw-type compressor provided in the low-pressure region 2 in conventional manner, via which valve the air inlet is controlled, and via which the air inlet will be closed when the multi-stage compressor 1 has been shut down. Moreover, air filter 12, oil filter 13, and fuel filter 14 of the drive engine 4 can be seen. Yet, what is substantial here is only the arrangement of the two cylinders 7 of the reciprocating piston compressor 6 in boxer construction.

Figure 3:
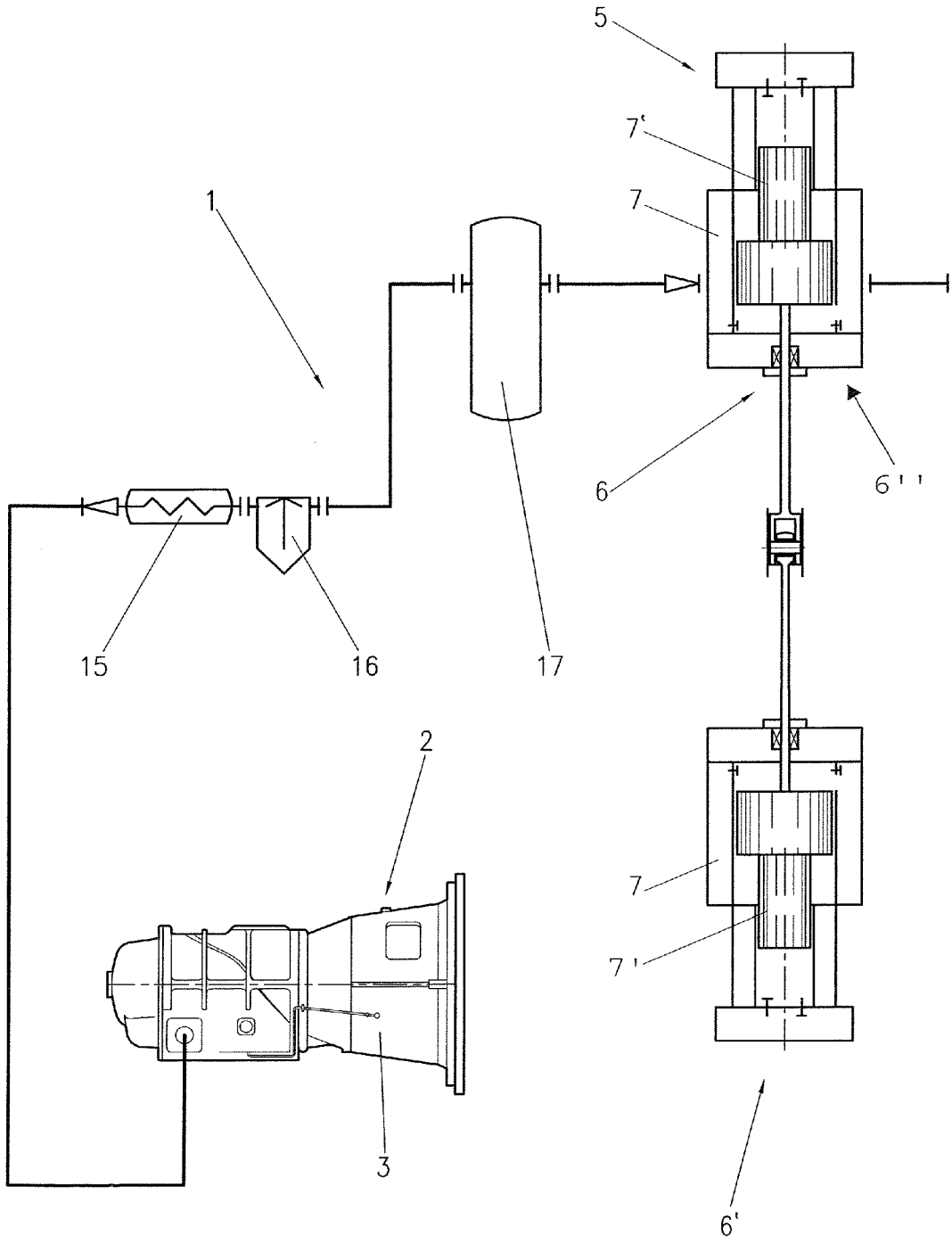
FIG. 3 schematically shows a block diagram of a multi-stage compressor with a two-stage high-pressure compressor.

In the block diagram of FIG. 3, it can be seen that a cooling device 15 is provided between the rotary compressor or screw-type compressor 3 in the low-pressure region 2 and the high-pressure region 5 in which a reciprocating piston compressor 6 with two compressor stages 6', 6" is located, said cooling device serving for cooling the gas which has an increased temperature due to internal compression, and that a condensate separator 16 is provided downstream thereof so as to allow for an efficient compression in the downstream high-pressure region 5. Furthermore, a pulsation attenuator 17 is provided for limiting the pressure oscillations of the gas to be compressed. Subsequently, the already pre-compressed gas enters the high-pressure region 5 in which a multi-stage piston compressor 6 is located having two opposing cylinders 7 and pistons 7' in each compressor stage 6', 6" so that—in addition to the compact construction of the multi-stage compressor 1 and the high compression efficiency—a high running smoothness of the whole assembly is ensured, making the multi-stage compressor 1 particularly suitable for use in mobile compressor plants and on ships.

Figure 4:
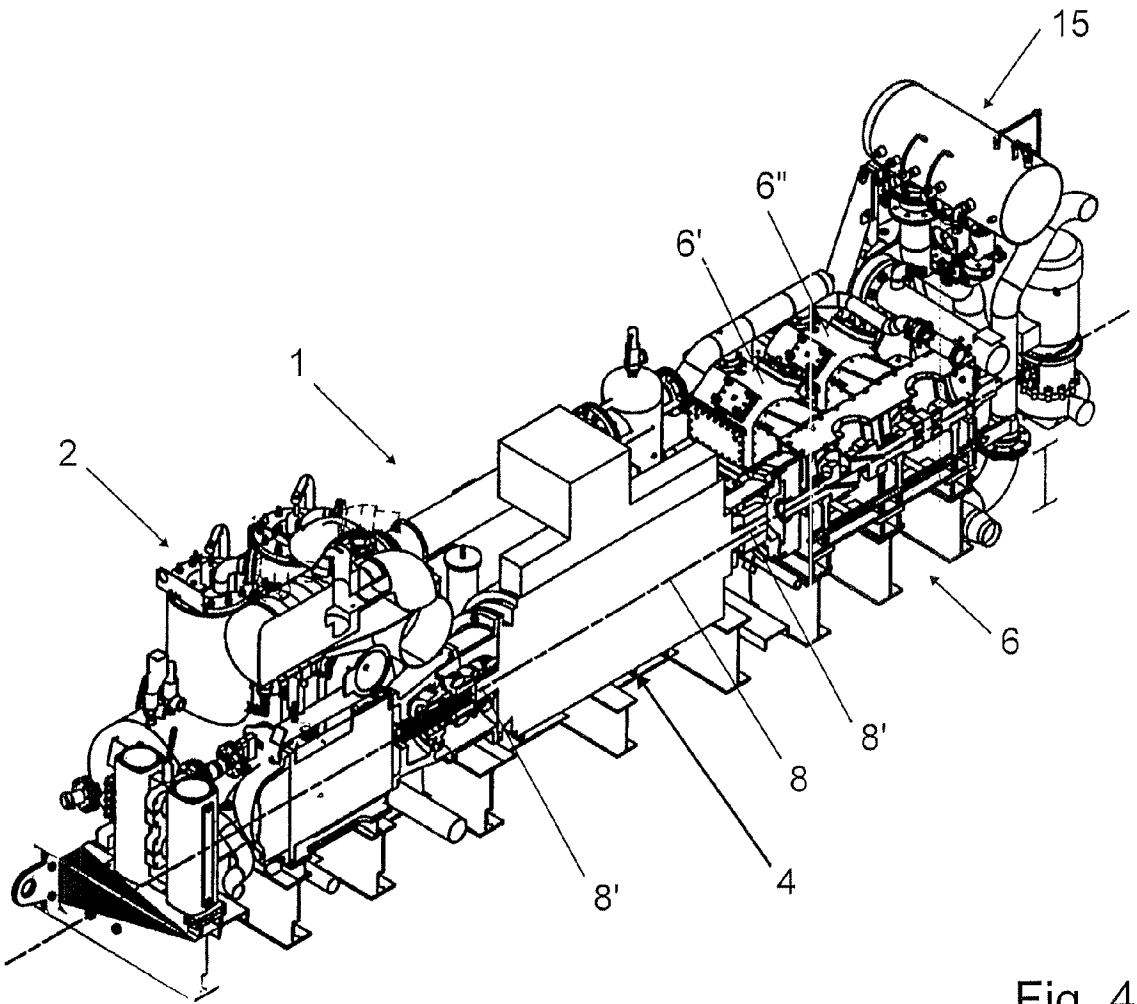
FIG. 4 shows a sectional view of another exemplary embodiment with a two-stage reciprocating piston compressor of boxer construction.

In FIG. 4, another exemplary embodiment of the multi-stage compressor 1 is shown, wherein the centrally arranged common engine 4 is particularly visible which has a crankshaft 8 with two stub shafts 8', wherein a screw-type compressor is driven in the low-pressure region 2 via one stub shaft 8', with the two-stage reciprocating piston compressor 6 being driven via the other stub shaft 8'.

Figure 5:
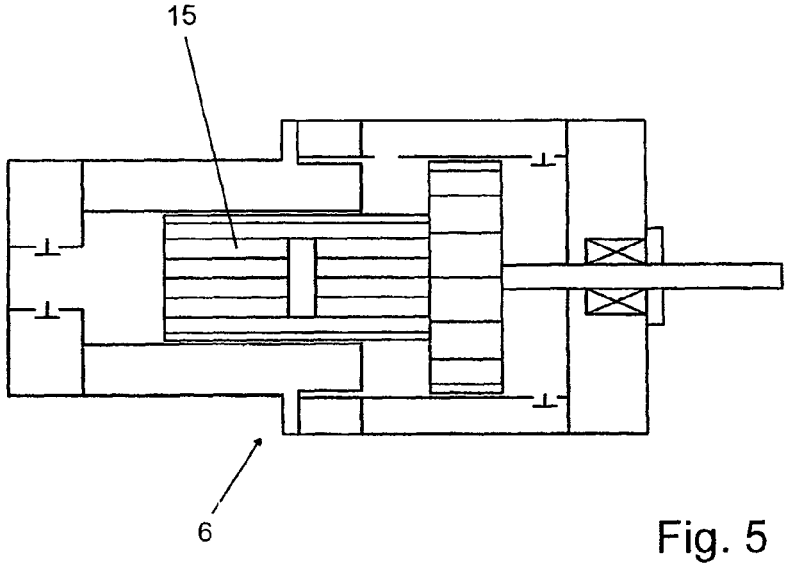
FIG. 5 shows a schematic sectional view of a cylinder with a stepped piston.
Figure 6:
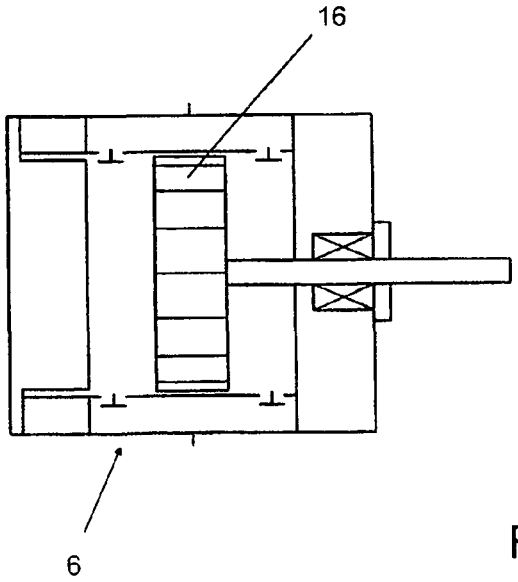
FIG. 6 shows a schematic sectional view of a double-acting cylinder.

The two compressor stages 6', 6" of the reciprocating piston compressor 6 of boxer construction, as can be seen in FIGS. 5 and 6, may be designed to be a stepped piston 15 or a double-acting cylinder 16. These two embodiment variants allow for a comparably short construction of the reciprocating piston compressor 6 to be achieved, thus enabling a comparably small span of the whole assembly 1 to be achieved with the arrangement of the cylinders 7 in the high-pressure region 5 in a manner rotated 180° relative to each other according to the invention, since the reciprocating piston compressor 6 has the largest width of the whole assembly 1. In particular, this allows for the installation of multi-stage compressors 1 in ISO containers having a width of 8 feet (2.44 m), what—together with the low center of mass of the whole assembly—constitutes a great advantage as regards mobile use, in particular on ships.

What is claimed is:

1. A multi-stage compressor for compressing gases comprising a low-pressure region and a high-pressure region, at least one screw-type compressor disposed in the low-pressure region, at least one reciprocating piston compressor having two cylinders disposed in the high-pressure region, a common engine for driving both the screw-type compressor and the reciprocating piston compressor, said engine having a crankshaft with a longitudinal axis that is substantially horizontal, said engine being disposed laterally next to the reciprocating piston compressor, wherein one stepped piston is received in each of the cylinders, wherein the cylinders oppose each other by 180° in the high-pressure region with longitudinal axes of the cylinders extending substantially horizontally such that the reciprocating piston compressor is arranged in a boxer construction thereby neutralizing the forces of inertia from the reciprocating stepped pistons during each crankshaft rotation, and wherein the screw-type compressor and the reciprocating piston compressor are coupled to the engine at opposing output sides.

2. The multi-stage compressor according to claim 1, wherein the reciprocating piston compressor has a plurality of compressor stages.

3. The multi-stage compressor according to claim 2, comprising at least one attentuator one cooling device, one condensate separator, one drying device or one gas separator disposed between the compressor stages.

4. A compressor plant comprising the multi-stage compressor of claim 1.

5. A ship comprising the compressor plant of claim 4 mounted thereon.

6. A multi-stage compressor for compressing gases with a low-pressure region and a high-pressure region, at least one screw-type compressor disposed in the low-pressure region, at least one reciprocating piston compressor with two cylinders disposed in the high-pressure region, a common engine for driving the screw-type compressor and the reciprocating piston compressor, said engine having a crankshaft with a longitudinal axis that is substantially horizontal, said engine being disposed laterally next to the reciprocating piston compressor, wherein one stepped piston is received in each of the cylinders, wherein the cylinders oppose each other by 180° in the high pressure region with longitudinal axes of said cylinders extending substantially horizontally such that the reciprocating piston compressor is arranged in a boxer construction thereby neutralizing the forces of inertia from the reciprocating stepped pistons during each crankshaft rotation, wherein the screw-type compressor and the reciprocating piston compressor are coupled to the engine at opposing output sides, and wherein the multi-stage compressor can be installed in an ISO container having a width of eight feet.

* * * * *